United States Patent [19]

Serrus Paulet

[11] 4,199,741

[45] Apr. 22, 1980

[54] MOVING MAGNET, ROTARY SWITCH

[76] Inventor: Edouard Serrus Paulet, Casa Nostra, Pech des Treilles, Puylaroque, France, 82240

[21] Appl. No.: 849,635

[22] Filed: Nov. 7, 1977

[30] Foreign Application Priority Data

Nov. 5, 1976 [FR] France ..... 76 33485

[51] Int. Cl.[2] ..... H01H 9/00

[52] U.S. Cl. ..... 335/206; 335/207

[58] Field of Search ..... 335/205, 206, 207

[56] References Cited

U.S. PATENT DOCUMENTS

| | | | |
|---|---|---|---|
| 2,827,531 | 3/1958 | O'Brien | 335/273 X |
| 3,277,413 | 10/1966 | Kropp et al. | 335/206 |
| 3,597,714 | 8/1971 | Brebbia et al. | 335/207 |
| 3,719,887 | 3/1973 | Shimizu et al. | 335/207 X |
| 3,859,612 | 1/1975 | Kashio | 335/207 X |

FOREIGN PATENT DOCUMENTS

| | | | |
|---|---|---|---|
| 1099631 | 1/1968 | United Kingdom | 335/205 |

*Primary Examiner*—George Harris

*Attorney, Agent, or Firm*—Haseltine, Lake & Waters

[57] ABSTRACT

A rotary switch comprising a stationary body provided with longitudinal bores in each of which a core of magnetic material is movable, switching means located at one end of said bores, and adapted to be actuated by the said cores and magnetic elements adapted to be brought successively opposite the ends of said bores to either displace or hold the said cores in the said bores for actuating the said switching means.

15 Claims, 11 Drawing Figures

MOVING MAGNET, ROTARY SWITCH

The present invention relates generally to rotary switches or programmers, of the type provided with permanent magnets for the switching of an electric or electronic circuit associated with the said switches or programmers.

There are generally known many types of rotary switches, which are used for switching over associated electric or electronic circuits. Such rotary switches often suffer from important drawbacks lying in their large size, difficult manufacturing, poor reliability and difficult actuation owing to the high-torque which must be exerted on the control knob of the switch in order to move the same from one angular position to another. Indeed, most of such switches comprise mechanical contact means associated with cams, or ratchet wheels or other click systems, as well as spring return means which greatly reduce their reliability owing to the risk of fatigue or breakage of the springs.

The known switches are generally characterized by a great number of moving members, a complex and difficult assembling procedure and their high driving torque.

The purpose of the present invention is precisely to avoid all the above drawbacks by providing a rotary switch which is very simple to manufacture and assemble, highly reliable, wherein no member is subjected to deformation and which requires only a very low driving torque.

The invention moreover provides a rotary switch of the type described which has very good impact and vibration behaviour and perfectly withstands high temperatures.

To this end the invention provides a rotary switch, comprising a control knob or element movable in rotation about a stationary longitudinal axis between predetermined angular positions each of which corresponds to a predetermined state of an electric or electronic circuit associated with the switch, characterized in that it comprises a stationary body provided with holes or bores parallel with the said axis and in each of which is placed a core of magnetic or ferro-magnetic material which is movable in translation in the corresponding bore between two end positions, switching means such as for example electromechanical, electric or electronic components arranged stationarily in or in proximity to one end of the said bores, whereas elements of magnetic or ferro-magnetic material are also arranged in proximity to one end of the bores and are driven in rotation about the said axis by the control knob so that each said element is brought opposite the corresponding ends of the bores so as to either displace or hold the said cores in one or other of their end positions each of which corresponds to a given state of the said components.

It is therefore observed that one of the essential features of the invention is that the rotary switch consists mainly of a stationary body provided with bores in which are placed cores movable in translation under the action of the magnetic repulsive or attractive forces produced by the magnets moving in rotation opposite the said bores successively. So the only rotating portion of the switch according to the invention is constituted by the magnets, so that friction during the rotation can be reduced to a minimum or to substantially zero and the driving torque required is extremely low.

Also of particular interest is the manfacturing and assembling simplicity of the rotary switch according to the invention.

The invention will be better understood and other purposes, features, details and advantages of the latter will appear more clearly from the following explanatory description with reference to the appended diagrammatic drawings given solely by way of example illustrating several forms of embodiment of the invention and wherein.

Figure 1:
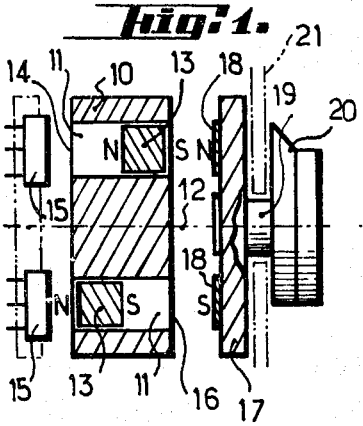
FIG. 1 is a diagrammatic cross-sectional view of the various components of a rotary switch according to the invention, separating from one another for a better understanding of the invention.

In FIG. 1 is therefore diagrammatically represented a rotary switch according to a first form of embodiment of the invention, in which the main components are shown separate from one another for a better understanding of the invention.

Figure 2:
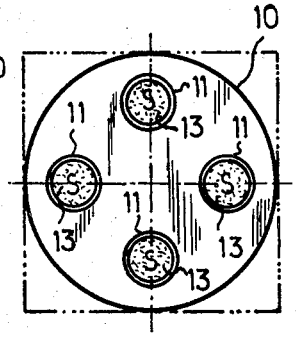
FIG. 2 is a front view of the stationary body of the rotary switch shown in FIG. 1.

The switch shown in this Figure comprises essentially a stationary body 10, a front view of which appears in FIG. 2 and which is for example cylindrical in shape and comprises a certain number of bores or holes 11 parallel with the longitudinal axis 12 of the stationary body 1. The bores, which are four in number in FIGS. 1 and 2, are equiangularly spaced from one another along a circumference.

Each of the bores contains a small core 13, for example also cylindrical in shape, which may be a permanent magnet and is generally made of a magnetic or ferro-magnetic material, e.g. of ferrite or rare-earth metal. On the side of a first end 14 of the bores are arranged switching elements 15 associated with an electric or electronic circuit, which may have two distinct switching or conduction states, and which pass from one state to the other depending upon the proximity or the remoteness of an associated magnetic or ferro-magnetic core 13. The elements 15 may be Hall-effect type semiconductors, piezo-electric or magnetostrictive elements, or, more simply, mechanical contactreed or -blade elements allowing a circuit to be opened or closed depending upon the close or remote position of the corresponding magnetic cores 13.

As is therefore understood, use can be made, in a switch according to the invention, of any switching element whose switching or conduction state varies according to the position of an associated magnetic core.

The switching elements 15 are advantageously carried by a plate, e.g a printed-circuit substrate or board, shown in dash-dotted lines in FIG. 1, and which closes the bottom of the stationary body 10.

On the side of the opposite end 16 of the bores 11 there is a circular plate or disc 17 arranged in perpendicular relationship to the longitudinal axis 12 and movable in rotation about the latter. The plate 17 carried on its surface facing the end 16 of the bores 11 four permanent magnets 18 or elements of magnetic or ferro-magnetic material which are mutually spaced on the said surface of the plate 17 in the same way as the afore-mentioned bores 11. The plate 17 is connected, e.g. by means of a shaft 19, with an actuating knob 20 with which it rotates jointly.

At 21 is shown in dash-dotted lines a plate which may form the front face of an electrical or electronic apparatus, provided with a hole through which the shaft 19 passes.

Figure 3:
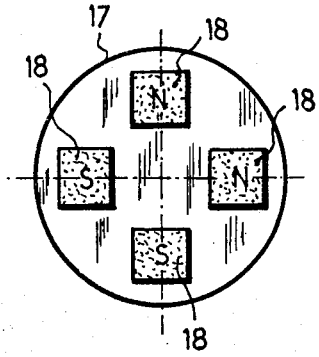
FIG. 3 is a front view of a plate or disc carrying the actuating magnets.

As shown in FIG. 1, the magnetic cores 13 may be arranged in the bores 11, with the same magnetic orientation, with the south poles directed towards the plate 17, whereas the north poles are directed towards the switching elements 15. In this case, if the magnetic orientation of the permanent magnets, or of the magnetic or ferro-magnetic elements, carried by the plate 17 is as shown in FIG. 3, the rotary switch of FIG. 1 forms an inverter or reversing switch acting upon four switching elements 15.

Of course, the elements 18 may also be arranged on the plate 17 with a completely different magnetic orientation.

It will also be noted that the switching elements may consist of photoelectric elements associated with a light source. In this case the light source may be located outside the stationary body 1 and the photoelectric elements may be placed within the stationary body 1 in regions which are apt to be exposed to the radiation of the light source when the magnetic cores 13 are in a first position and screened by the magnetic cores in their second position.

Figure 4:
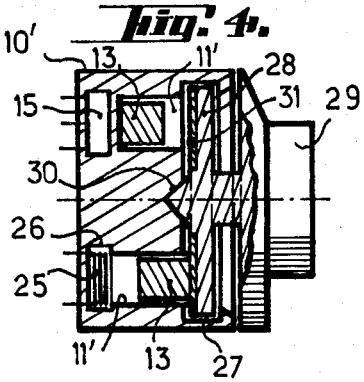
FIG. 4 is a diagrammatic sectional view illustrating two modified forms of embodiment of a rotary switch according to the invention.
Figure 5:
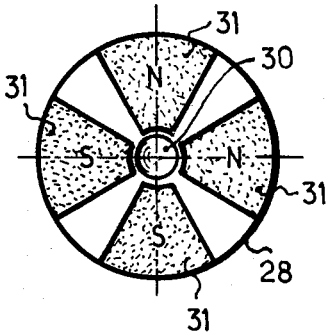
FIG. 5 is a front view of the rotary plate or disc of the switch of FIG. 4.

In a more elaborate form of embodiment represented in FIG. 4, the switching elements 15 may be sunk in the botton of the stationary body 10', the bores 11' being either blind at their end directed towards the switching elements 15 or open towards the said elements.

In the lower portion of FIG. 4 the switching element shown consists of one or several turns 25 of conductor wire which are arranged on the internal wall of a counter-bore 26 slightly greater in diameter than the corresponding bore 11', so that the associated magnetic core 13, in one of its end positions, may enter the spires 25 located in the counter-bore 26 and produce an induced current which is used to bring about the switching of an associated circuit.

In the form of embodiment of FIG. 4 the front portion of the stationary body 10' forms a circular groove 27 in which is resiliently engaged a disc or plate 28 jointly rotatable with the actuating knob 29. The central portion of the plate 28 may be in the form of a pointed taper 30 engaged in a corresponding conical hole of the stationary body 10' and allowing the rotary plate 28 to be positioned and centred. On the surface of the latter which faces the magnetic cores 13 are provided magnetic or ferro-magnetic sectors 31 arranged on the plate in the same manner as the bores 11' containing the magnetic cores 13.

It is therefore seen that the rotary switch shown in FIG. 4 is extremely simple to manufacture and assemble. The stationary body 10 or 10' may be made of any suitable material, e.g. moulded or injected plastics, in which the switching elements 15 may be sunk, and the rotary discs or plates 17 or 28 may also be made of injected or moulded plastics. The fixing of the permanent mangets 18 or the provision of the angular sectors 31 on the rotary plate 17 or 28, respectively, raises no problem.

It will also be noted that a great number of different rotary switches may be obtained with a single type of stationary body 10 or 10', by only changing the magnetic orientations of the elements 18 or 31 carried by the rotary plates 17 or 28.

The stationary bodies may be either cylindrical in shape or rectangular or square in cross-section as shown in dash-dotted lines in FIG. 2.

Figure 6:
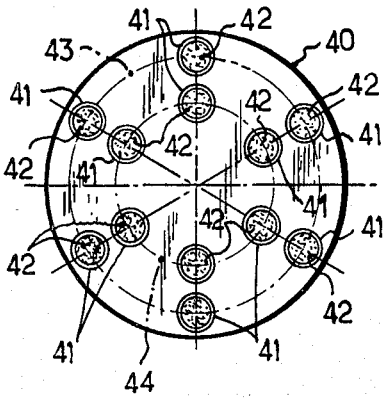
FIG. 6 is a diagrammatic front view of a stationary body of a switch according to another modified form of embodiment of the invention.

The said stationary bodies may have very small dimensions, e.g. on the order of 1 $cm^2$, or they may have larger dimensions and be provided with a relatively great number of bores containing magnetic cores as shown for example in FIG. 6. In this case the stationary body 40, e.g. cylindrical in shape, comprises twelve cylindrical bores with each of which is associated a switching element (not shown). The twelve bores, each of which contains a magnetic core 42, are arranged in two groups of six, the first group of six bores 41 being arranged equiangularly along a first circumference 43 and the second group of six bores 41 being arranged equiangularly along a circumference 44 concentric with and smaller in diameter than the former. The corresponding bores of the first and second groups are aligned in pairs along the radii of the stationary cylindrical body 40.

Figure 7:
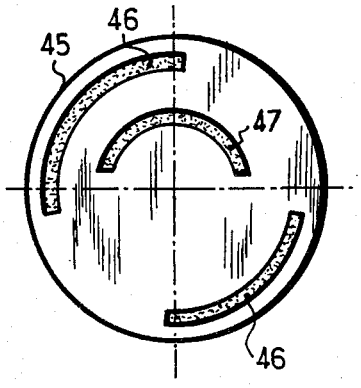
FIG. 7 is a diagrammatic front view of a rotary plate or disc which can be associated with the stationary body of the switch shown in FIG. 6.

In this case the rotary plate 45 associated with this stationary body may be designed as is shown in FIG. 7, i.e. in the form of a disc provided on its corresponding face with arcuate portions 46 and 47 of magnetic or ferro-magnetic material formed at appropriate locations over portions of circumferences the radii of which are the same as those of the circumferences 43 and 44 along which are arranged the bores 41 of the stationary body.

It is thus understood that a decimal-binary coding device can be obtained by means of the rotary switch illustrated in FIGS. 6 and 7.

It will be noted that the actuation of the rotary switch according to the invention is extremely simple and requires practically no effort, owing to the small resistance offered by the magnetic attractive or repulsive forces to the shearing or perpendicular stresses. In addition, the accurate positioning of the rotary plate 17 or 28 in each predetermined angular position takes place automatically owing to the very principle underlying the switch according to the invention. If desired, or in some particular cases, however, there can be provided on the movable portion of the switch automatic positioning means which may consist for example of stop-notch or ratchet-wheel systems positively indicating the predetermined angular positions into which the rotary plates 17 or 28 must be moved.

It may be specificed, by way of example, that the magnetic forces used may vary from 100 to 500 grams according to the types of magnets used (ferrite or rare-earth metal). If the mass of the magnetic cores is on the order of about 5 grams a force of 500 grams applied on the core corresponds to an acceleration of 100 g, where g is the acceleration of gravity. It is therefore understood that such a rotary switch is capable of withstanding impacts or vibrations with acceleration values up to 100 g. Moreover, the Curie point of the magnetic or ferro-magnetic materials used may exceed 400° C., so that a rotary switch according to the invention can keep its operating ability up to temperatures ranging about that value.

Moreover, the bores of the stationary body may be easily closed absolutely sealingly, thus protecting the cores from dust, moisture, etc. and ensuring their unhindered translational movements in the bores. Also, after the bores are thus closed, they can be easily evacuated so as to prevent the resistance of the air from hindering the movement of the magnetic cores.

Also to be noted is the fact that the travel of the magnetic cores may be relatively small, e.g. of the order of from 2 to 3 minutes, and that also the dimensions of the cores may be very small, so that it is possible to make rotary switches according to the invention in which the volume of the stationary bodies used does not exceed 1 $cm^3$.

Figure 8:
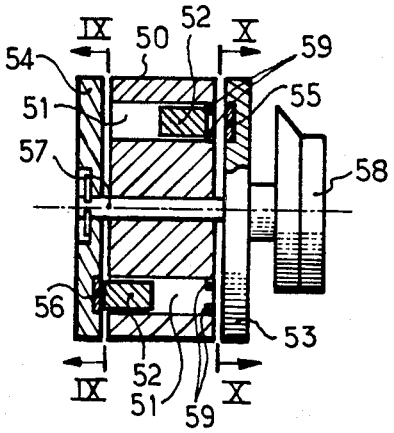
FIG. 8 is a diagrammatic sectional view illustrating another form of embodiment of the invention.
Figure 9:
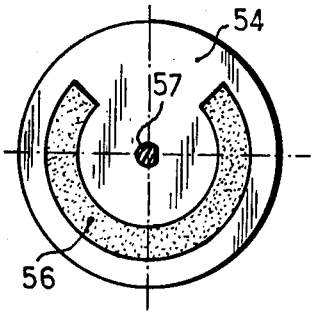
FIGS. 9 and 10 are front views of the rotary discs of the apparatus of FIG. 8.
Figure 10:
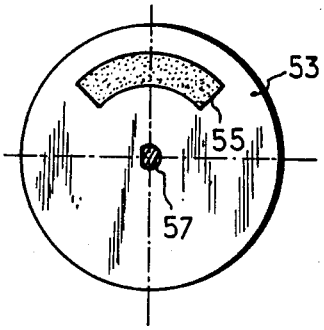

Another form of embodiment is shown in FIGS. 8 to 10, wherein the rotary switch comprises as previously a stationary body 50 provided with a certain number of bores 51, each of which contains a core 52 of magnetic or ferro-magnetic material, and the stationary body is comprised between two flat rotary plates or discs 53 and 54, respectively, arranged opposite its ends and each provided on one of its faces with angular regions 55 and 56, respectively, which are better seen in FIGS. 9 and 10. These two plates are mounted with a predetermined angular orientation with respect to one another and rotate jointly with a common shaft 57 which may be splined or provided with a flat part and which passes through the stationary body 50 along its longitudinal axis.

One of the rotary plates, e.g. the plate 53, rotates jointly with the actuating knob 58.

At least one end of each bore 51 may be provided, as shown in FIG. 8, with two contact elements 59 forming an interrupter with the corresponding core 52 of electrically conductive material.

The contact elements 59 may be sunk in the material of the stationary body 50 and connected in a suitable manner to an external electric circuit, or they may be carried by a separate thin plate, e.g. a printed-circuit substrate or board applied on the corresponding face of the stationary body 50.

It will also be noted that the angular regions 55 and 56 of magnetic or ferro-magnetic material of the discs 53 and 54 are so arranged that the region 55 of the disc 53 corresponds to the annular circular space which is left free by the region 56 of the disc 54, as shown in FIGS. 9 and 10. The regions 55 and 56 may constitute permanent magnets, in which case the cores 52 are made for example of soft or mild iron; alternatively the cores 52 may constitute magnets, and the regions 55 and 56 may be for example of mild or soft iron.

The operation of the apparatus shown in FIG. 8 is as follows: in each angular position of the knob 58, at least one of the cores 52 is attracted towards the region 55 of the disc 53 thus electrically connecting the corresponding contact elements 59, whereas at least one of the other cores 52 is attracted towards the region 56 of the other disc 54 thus opening the electric circuit between the corresponding contact elements 59. These switching states are modified by rotating the knob 58.

Figure 11:
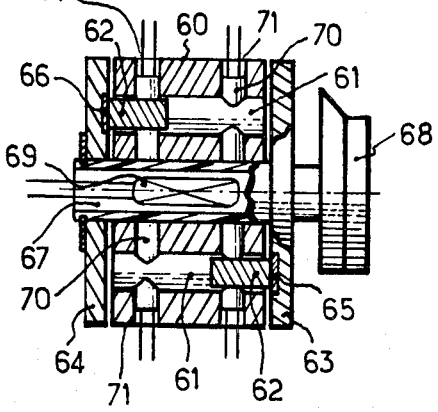
FIG. 11 is a sectional view illustrating another form of embodiment of the invention.

In the form of embodiment illustrated in FIG. 11, the stationary body 60 comprises, as previously, longitudinal bores 61 containing each a sliding core 62. The stationary body 60 is arranged between two rotary plates or discs 63 and 64 carried by one and the same shaft 67 passing axially through the stationary body 60, and both discs 63 and 64 are also provided with annular regions 65 and 66, respectively, as in the foregoing form of embodiment.

In this case, however, the shaft 67 is made of transparent plastics and contains a light source 69 which is fixed both in rotation and in translation in the transparent hollow shaft 67.

The stationary body 60 is provided with two series of radial bores 70 extending perpendicularly through the bores 61 and opening at one end onto the external surface of the stationary body 60 and at their other end onto the transparent hollow shaft 67. A component such as a phototransistor 71 is mounted in the outer end of each radial bore 70. As seen in FIG. 11, each longitudinal bore 61 is traversed perpendicularly by two radial bores 70 parallel with one another and so spaced from one another that the corresponding core 62 always closes one or another of the bores 70 when attracted towards the disc 63 or towards the disc 64, respectively.

Thus, each core 62, in moving from one end to the other end of the longitudinal bore 61, screens one of the associated phototransistors 71 and leaves the other phototransistor 71 exposed to the radiation from the light source 69, which may be a simple light-emitting or electroluminiscent diode or a simple small-size lighting bulb.

It is readily understood that by rotating the actuating knob 68 carried by the hollow shaft 67, the switching state of the apparatus can be modified, the phototransistors 71 being alternately conductive and non-conductive.

What is claimed is:

1. A rotary switch, comprising a stationary body having a longitudinal axis and having bores parallel with said axis, switching means arranged stationarily at least in proximity of an end of said bores, magnetic cores each placed in one of said bores and slidingly movable therein between two end positions each corresponding to a switching state of a corresponding switching means, an actuating element movable in rotation about said axis, and elements of magnetic material arranged in proximity to at least one end of said bores and driven in rotation by said actuating elements so as to be brought successively opposite the said ends of the bores for moving at least some of said cores and changing the switching states of the corresponding switching means.

2. A rotary switch according to claim 1, wherein said elements of magnetic material are carried by a plate arranged in perpendicular relationship to the said axis and driven in rotation by the actuating elements.

3. A rotary switch according to claim 1, wherein said elements driven in rotation are permanent magnets.

4. A rotary switch according to claim 2, wherein said elements are angular sectors of magnetic material.

5. A rotary switch according to claim 1, wherein said cores are permanent magnets.

6. A rotary switch according to claim 1, wherein said switching means are mechanical-contact elements.

7. A rotary switch according to claim 5, wherein said switching means are components the conduction state of which varies substantially according to the proximity or remoteness of an associated permanent magnet.

8. A rotary switch according to claim 1, wherein said switching means are arranged in a first end of the bores for closing said first end, said switching means being sunk in a bottom face of said stationary body.

9. A rotary switch according to claim 1, wherein said switching means are carried by a separate plate for forming a bottom of said stationary body.

10. A rotary switch according to claim 1, wherein said bores containing the cores are evacuated and sealingly closed.

11. A rotary switch according to claim 1, wherein said stationary body comprises a plurality of bores arranged along a plurality of concentric circumferences and equiangularly spaced from one another.

12. A rotary switch according to claim 1, wherein said switching means are carried by said stationary body, and a rotary plate carrying said elements of magnetic material is arranged opposite each end of said stationary body, both plates rotating jointly with one and the same shaft extending along the central axis of said stationary body.

13. A rotary switch according to claim 12, wherein said surfaces of the two rotary plates facing the ends of said stationary body have magnetic angular regions which are substantially diametrically opposite each other from one plate to the other.

14. A rotary switch according to claim 12, wherein said cores are of soft iron, the angular regions comprising magnets.

15. A rotary switch according to claim 12, wherein said cores are permanent magnets and the angular regions are of soft iron.

* * * * *